US009123264B2

(12) United States Patent
Garfinkle et al.

(10) Patent No.: US 9,123,264 B2
(45) Date of Patent: Sep. 1, 2015

(54) SIGN HOLDER DEVICE

(75) Inventors: Benjamin L. Garfinkle, Piedmont, CA (US); Manu B. Makhija, Castro Valley, CA (US)

(73) Assignee: Clamp Swing Pricing Co., Oakland, CA (US)

( * ) Notice: Subject to any disclaimer, the term of this patent is extended or adjusted under 35 U.S.C. 154(b) by 2429 days.

(21) Appl. No.: 10/147,669

(22) Filed: Jul. 22, 2002

(65) Prior Publication Data

US 2002/0174582 A1 Nov. 28, 2002

Related U.S. Application Data

(62) Division of application No. 09/684,726, filed on Oct. 6, 2000, now Pat. No. 6,530,166.

(51) Int. Cl.

| | |
|---|---|
| ***G09F 7/20*** | (2006.01) |
| ***G09F 15/00*** | (2006.01) |
| ***G09F 3/20*** | (2006.01) |
| ***G09F 7/18*** | (2006.01) |
| ***G09F 7/22*** | (2006.01) |

(52) U.S. Cl.

CPC ..... *G09F 15/0087* (2013.01); *G09F 3/20* (2013.01); *G09F 7/18* (2013.01); *G09F 7/20* (2013.01); *G09F 7/22* (2013.01); *G09F 15/0037* (2013.01); *G09F 15/0056* (2013.01)

(58) Field of Classification Search

CPC ..... G09F 7/18; G09F 2007/1804; G09F 7/20; G09F 15/0037; G09F 15/0056; G09F 2007/1817; G09F 7/00; G09F 2007/1808; G09F 15/0012; G09F 15/00; G09F 1/12; G09F 1/14; E04H 13/003; A47G 29/1209

USPC ..... 40/308, 607.1, 607.11; 211/90.03, 211/119.003, 59.2, 59.1, 87.01; 248/434, 248/540, 541, 447.2

See application file for complete search history.

(56) References Cited

U.S. PATENT DOCUMENTS

| | | | | | |
|---|---|---|---|---|---|
| 1,435,785 | A | * | 11/1922 | Alexander | 248/165 |
| 1,837,348 | A | * | 12/1931 | Ware | 40/763 |
| 2,208,344 | A | * | 7/1940 | Reynolds | 40/611.06 |
| 4,134,222 | A | | 1/1979 | Orsos | 40/606 |
| 4,166,332 | A | | 9/1979 | Donovan | |
| 4,593,486 | A | | 6/1986 | Visocky et al. | |
| 4,630,386 | A | | 12/1986 | Wilson | |
| 4,777,750 | A | * | 10/1988 | Garfinkle | 40/607.04 |
| 4,852,838 | A | * | 8/1989 | Field | 248/222.13 |
| 5,090,145 | A | | 2/1992 | Chiang et al. | |
| 5,099,589 | A | | 3/1992 | Lai | |
| 5,655,670 | A | * | 8/1997 | Stuart | 211/43 |
| 5,666,751 | A | | 9/1997 | Garfinkle | |
| 5,901,482 | A | * | 5/1999 | Sawyer et al. | 40/308 |
| 6,023,871 | A | * | 2/2000 | Horowitz | 40/642.01 |

(Continued)

*Primary Examiner* — Casandra Davis

(74) *Attorney, Agent, or Firm* — Bay Area Technology Law Group PC

(57) ABSTRACT

A sign holder in the form of individual parts which, upon assembly, provides for the support and display of signage in a plurality of orientations. The sign holder includes a base configured to receive and support a first end to the stem, the stem having a first end and second end, the first end configured to be releasably retained by the base and the second end configured to retain a sign frame. The sign frame, in turn, is configured to be releasably retained by the second end of the stem and have a left side and a right side and a gap between its sides. The gap is provided with tabs for positioning the stem on the sign frame to retain the stem in a predetermined location.

12 Claims, 10 Drawing Sheets

(56) References Cited

U.S. PATENT DOCUMENTS 6,044,982 A * 4/2000 Stuart ..... 211/43
6,125,566 A * 10/2000 McLaughlin ..... 40/737
6,293,511 B1 9/2001 Shepherd
D456,182 S * 4/2002 Hamilton et al. ..... D6/491

* cited by examiner

SIGN HOLDER DEVICE

RELATED APPLICATIONS

The present application is a divisional of U.S. application Ser. No. 09/684,726 filed on Oct. 6, 2000.

TECHNICAL FIELD OF THE INVENTION

The present invention is directed to a sign holder device in the form of individual parts which, upon assembly, provide for the support and display of signage in a plurality of orientations. By employing devices as taught herein, a retail facility can inventory a bin of parts and construct signage of a variety of configurations and orientations avoiding the need to stockpile signs of fixed geometry.

BACKGROUND OF THE INVENTION

Retail establishments such as supermarket chains require signage of every imaginable configuration. Every product sold requires some type of sign to inform a consumer of the nature and price of products on display. For example, produce such as oranges, bananas and grapefruit require one type of signage while frozen food bins and deli cases yet others. It is impractical for a multi-product retail establishment such as a grocery chain to inventory preassembled signage for each dedicated orientation. A far better solution is to provide the retailer with an inventory of parts which can be assembled on site depending upon the product display requiring such signage.

The present invention is not the first instance in which it was suggested that retail store signage be provided from a parts bin rather than as assembled members. However, prior knockdown component oriented kits have not been universally embraced by the retail trade for several reasons. Products of this nature of the prior art tend to be flimsy, and not easily assembled and disassembled and oftentimes require a certain level of skill and experience in converting the bin of parts to professionally looking customer-inviting signage. For example, it is oftentimes important to position a sign frame appropriately upon a support stem in order to make the sign support professional looking. It is not difficult to produce geometrically centered frames upon support stems at a factory location when a product is produced which is not intended to be disassembled on site. However, retail store employees are called upon to work quickly moving from one location to the next and it is oftentimes incumbent upon them to assemble and disassemble signage rapidly. Kit products of the prior art, when assembled rapidly by non-skilled personnel, tend to look haphazard and not professional in construction.

It is also important to manufacturers of such products to be able to construct signage from a bin of parts. Flexibility enjoyed by retail store employees as noted above also provides advantages for manufacturers for a multiple of signage products can be constructed by picking and choosing individual components enabling a wide variety of preconstructed signage products to be shipped to customers without having to inventory a myriad of molds for each variation.

It is thus an object of the present invention to provide a sign holder device in the form of individual parts which, when assembled, provides for a professional appearing support for the display of signage in a plurality of orientations.

This and further objects will be more readily apparent when considering the following disclosure and appended claims.

SUMMARY OF THE INVENTION

The present invention is directed to a sign holder device in the form of individual parts which, upon assembly, provide for support and display of signage in a plurality of orientations. The sign holder device comprises a base configured to receive and support the first end of a stem, the stem having a first end and a second end. The first end of the stem is configured to be releasably retained by the base while the second end is configured to retain a sign frame. The sign frame, in turn, is configured to be releasably retained by the second end of the stem and includes a left side and a right side and gap between these sides. The gap is provided with tabs for positioning the stem on the sign frame to retain the stem on the frame in a predetermined orientation. Alternatively, the frame can be supported directly by the base, thus eliminating the stem when appropriate.

BRIEF DESCRIPTION OF THE DRAWINGS

FIG. 12A is a perspective view of a base member for use between wooden slats while

DETAILED DESCRIPTION OF THE INVENTION

Figure 1:
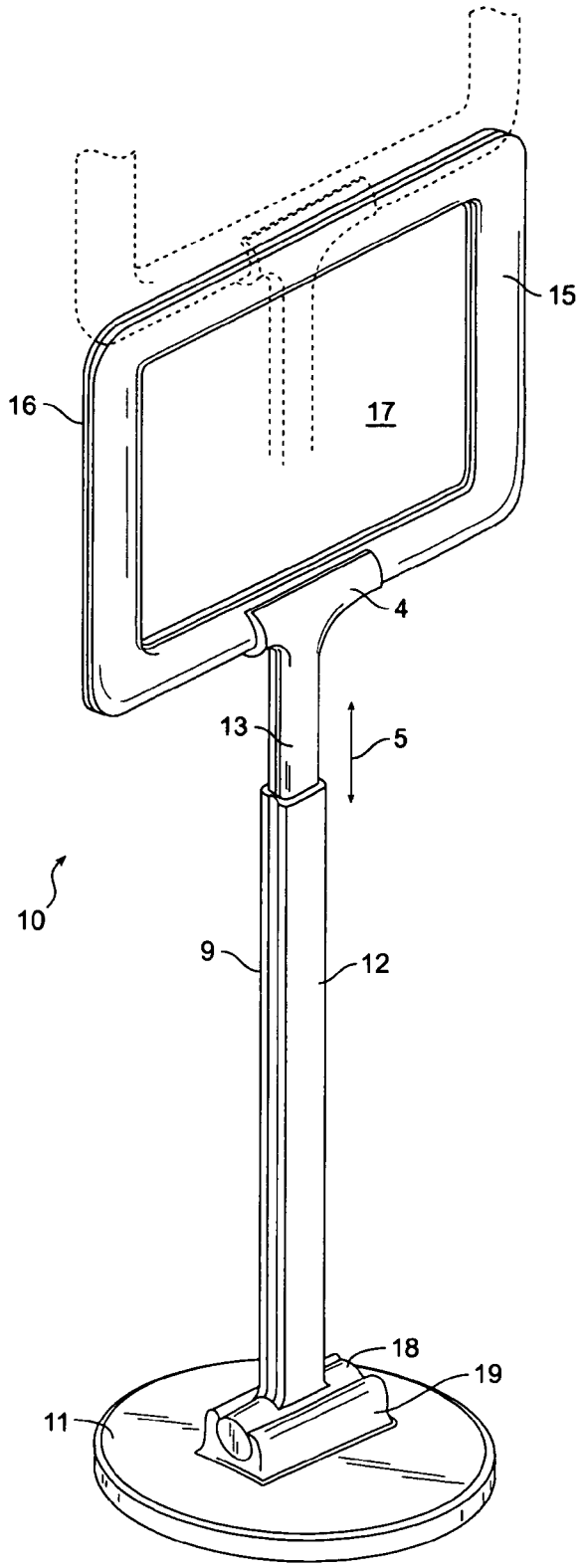
FIG. 1 is a perspective view of one variation of an assembled sign frame produced from the parts of the present invention.

Turning to FIG. 1, the present sign holder device is shown whereby the various individual parts have been joined. Sign holder device 10 is shown constructed of base 11, stem 9 and frame halves 15 and 16, each of which being capable of rapid disassembly and reassembly on site.

The base employed to support the remaining parts of the sign holder device can be of several different configurations depending upon the surrounding structure used to support it. When the sign holder device is intended to be placed upon a flat horizontal surface such as that of a table or counter, base 11 is most appropriate.

Figure 2:
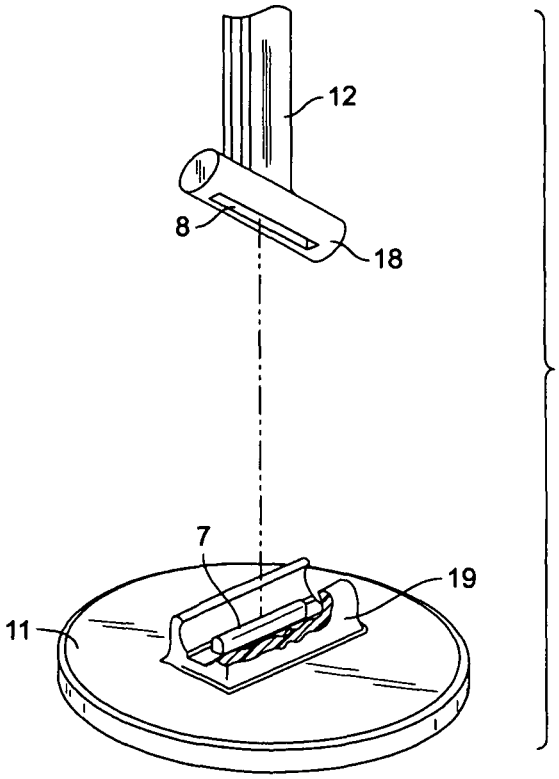
FIG. 2 is an exploded view illustrating in perspective the joining of base and stem members of the present invention.

Base 11 includes C-shaped receiving element 19 which is sized to frictionally retain cylindrical portion 18 of stem 9 as shown or frame halves 15 and 16 if stem 9 is eliminated. As best depicted in FIG. 2, cylindrical portion 18 of stem 9 preferably being unitarily molded as part of outer sleeve 12 is further provided with slot 8. Once cylindrical element 18 is frictionally fit within C-shaped receiving element 19, ridge 7 is intended to fit within slot 8 for the purpose of maintaining stem 9 completely perpendicular to the plane of base 11 and the surface (not shown) on which is resides.

As noted by reference to FIG. 1, frame halves 15 and 16 are sized to create open region 17 which is intended to accept signage slid between the frame halves as needed. Gap 21 can also accept ridge 7 in base 11 if the frame is intended to reside within the base, eliminating stem 9.

Figure 3:
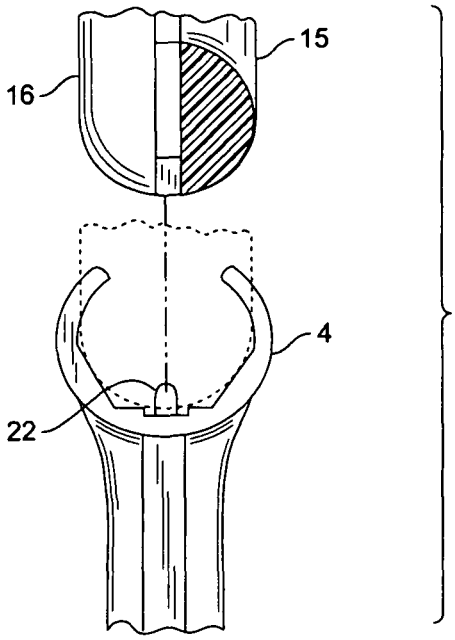
FIG. 3 is an exploded side view showing, the joining of frame and stem members pursuant to the present invention.
Figure 6:
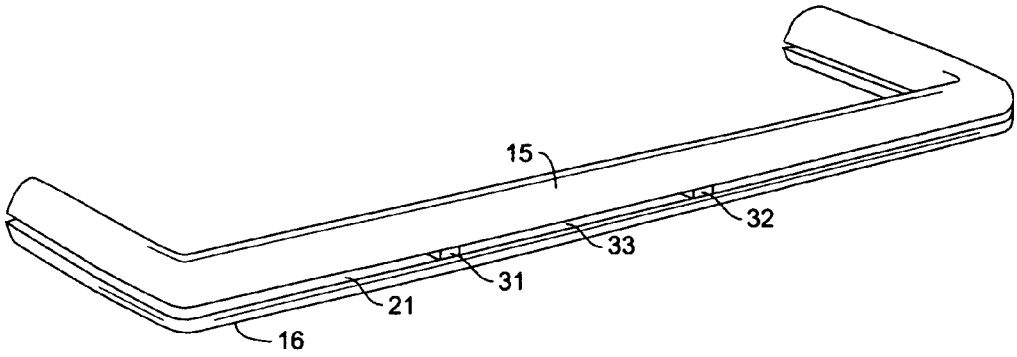
FIG. 6 is a partial perspective view of the frame member of the present invention showing the necessary gap between the frame halves and tabs employed for aligning the stem.

Frame halves 15 and 16 when snap fit together are separated from one another by shoulders (not shown) creating gap 21. Ridge 22 (FIG. 3) can be caused to pass within and be captured by gap 21 in region 33 (FIG. 6) as C-shaped member 4 frictionally captures the outer surface of frame halves 15 and 16. Ridge 22 is configured to fit within region 33 and be bounded by centering ribs 31 and 32 which positions stem 9 at the geometric center of the frame. As such, when a manufacturer or when an employee is desirous of rapidly creating sign 10 from a bin of parts including frame halves 15 and 16, stem 9 and base 11, the frame halves will only seat upon stem 9 or base 11 at a properly positioned geometrically centered location and in a vertical (non-rotating) orientation resulting in signage which is aesthetically pleasing. Without this feature, rapid assembly can oftentimes result in a misaligned sign frame giving one the impression that the frame is misconstructed resulting in the sign drawing attention to itself and away from the information intended to be displayed within area 17.

Figure 9:
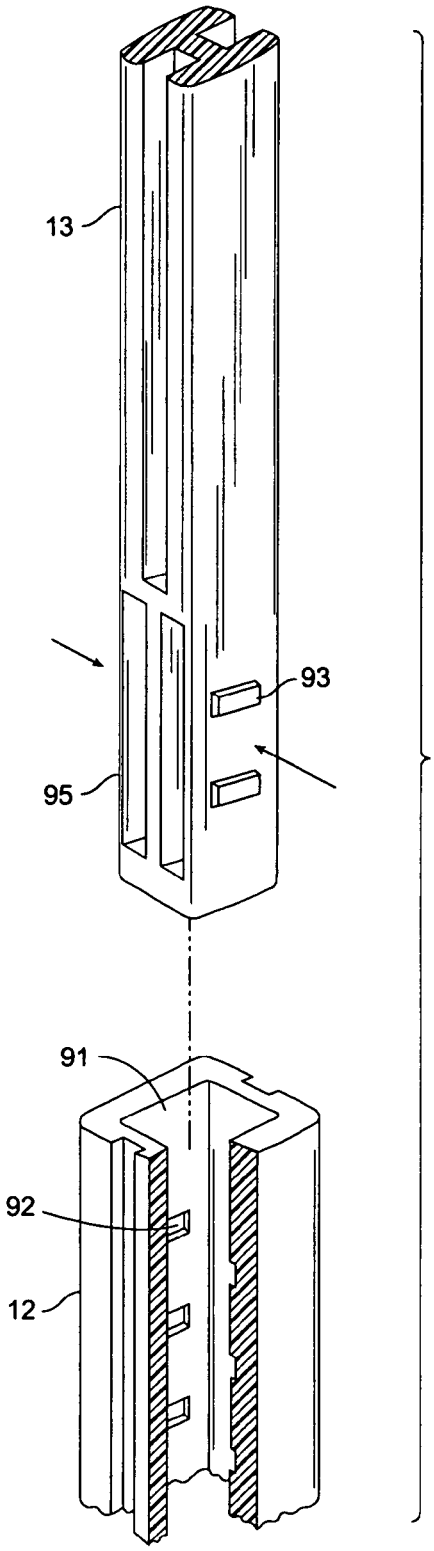
FIG. 9 is a side view showing a portion of the stem of the present invention.

Although the present invention contemplates stems which are not adjustable, as a further embodiment, as noted by arrow 5 and the phantom lines of FIG. 1, it is contemplated that the vertical height of signage 10 be adjustable by providing stem 9 with inner shaft 13 and outer sleeve 12. As a preferred embodiment, reference is made to FIG. 9 showing the details of the construction of inner shaft 13 and outer shaft 12. Specifically, inner shaft 13 is provided with protrusions 93 positioned on thinned side wall 95. As inner shaft 13 is moved along outer shaft 12, inner shaft 13 is caused to frictionally fit within space 91 while protrusions snap release along indents 92 to provide a stutter motion as stem 9 is extended or retracted.

Figure 4:
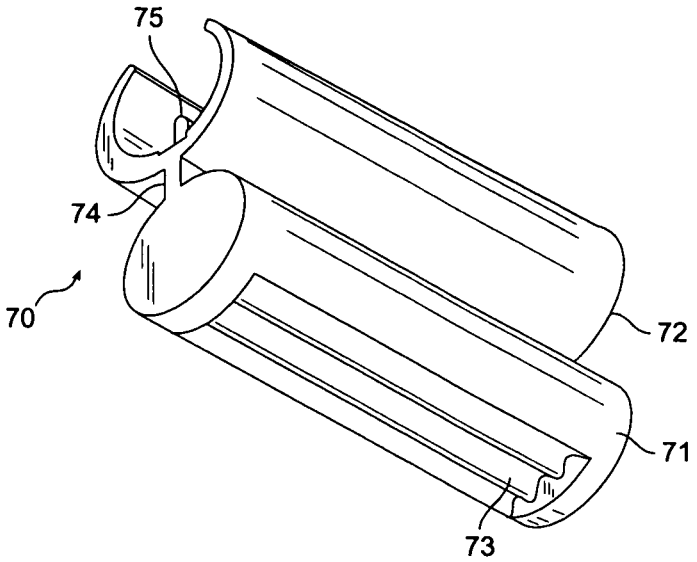
FIG. 4 is a perspective view of an adapter employed as a preferred embodiment for use herein.
Figure 5:
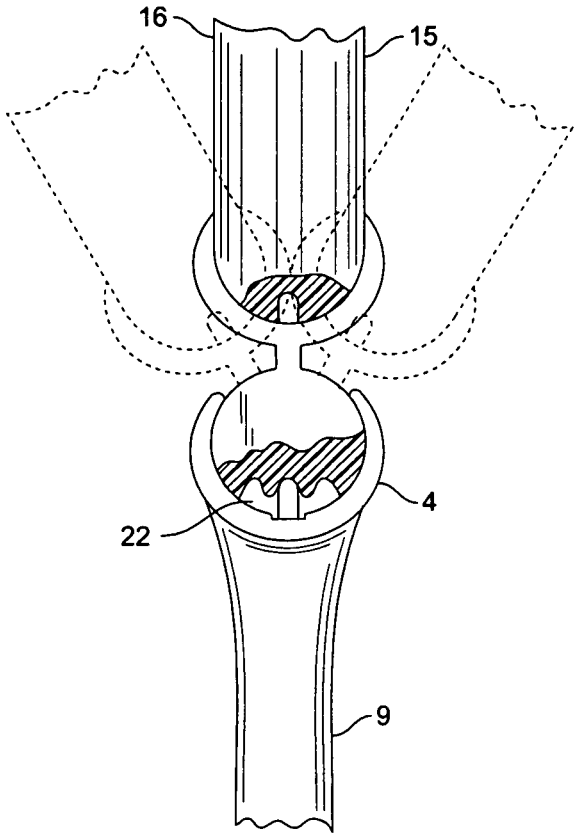
FIG. 5 is a side view showing the use of the adapter of FIG. 7 in practicing the present invention.

As a further preferred embodiment, reference is made to FIGS. 4 and 5 illustrating an embodiment whereby sign halves 15 and 16 can be angled with respect to stem 9 or stem 9 can be angled with regard to base 11 through the use of a single adapter as shown in FIG. 4.

Turning to FIG. 4, adapter 70 is composed of cylindrical portion 71 and C-shaped portion 72 connected by web region 74. Cylindrical portion 71 is provided with a series of indents 73; in this particular illustrated embodiment, three such indents are shown. In reference to FIG. 5, when adapter 70 is frictionally fit within C-shaped section 4 at the second end of stem 9, frame halves 15 and 16 can be rotated from vertical as shown by phantom lines whereby protrusion 22 seats within various indents 73 as lateral pressure is placed along the sign frame.

Although not shown, adapter 70 can likewise be frictionally fit within C-shaped section 19 whereby ridge 7 (FIG. 2) can also cause to reside within adjacent indent 73 as lateral pressure is placed along stem 9.

As noted previously, base 11 is intended to reside upon a flat horizontal surface such as a table or countertop. As alternative embodiments, reference is made to FIGS. 7 and 8 showing alternatives to base 11.

Figure 7B:
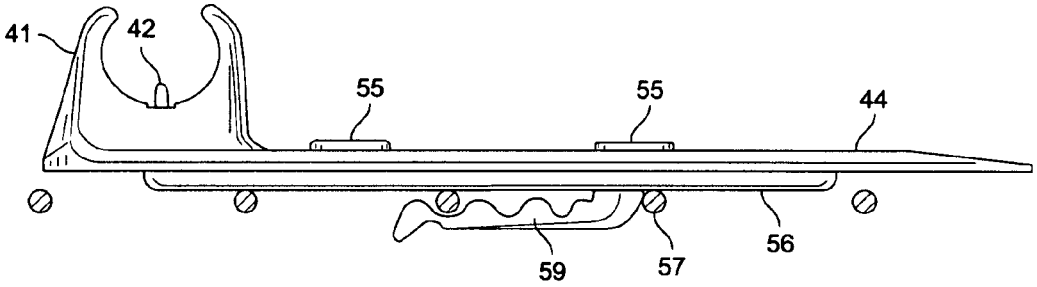
FIGS. 7A and B are an exploded view and side plan view, respectively, of yet another embodiment of the present invention, in this instance, a two part base configuration for adjoining signage to a wire rack typically found in refrigerated cases of the type employed by supermarkets.
Figure 7A:
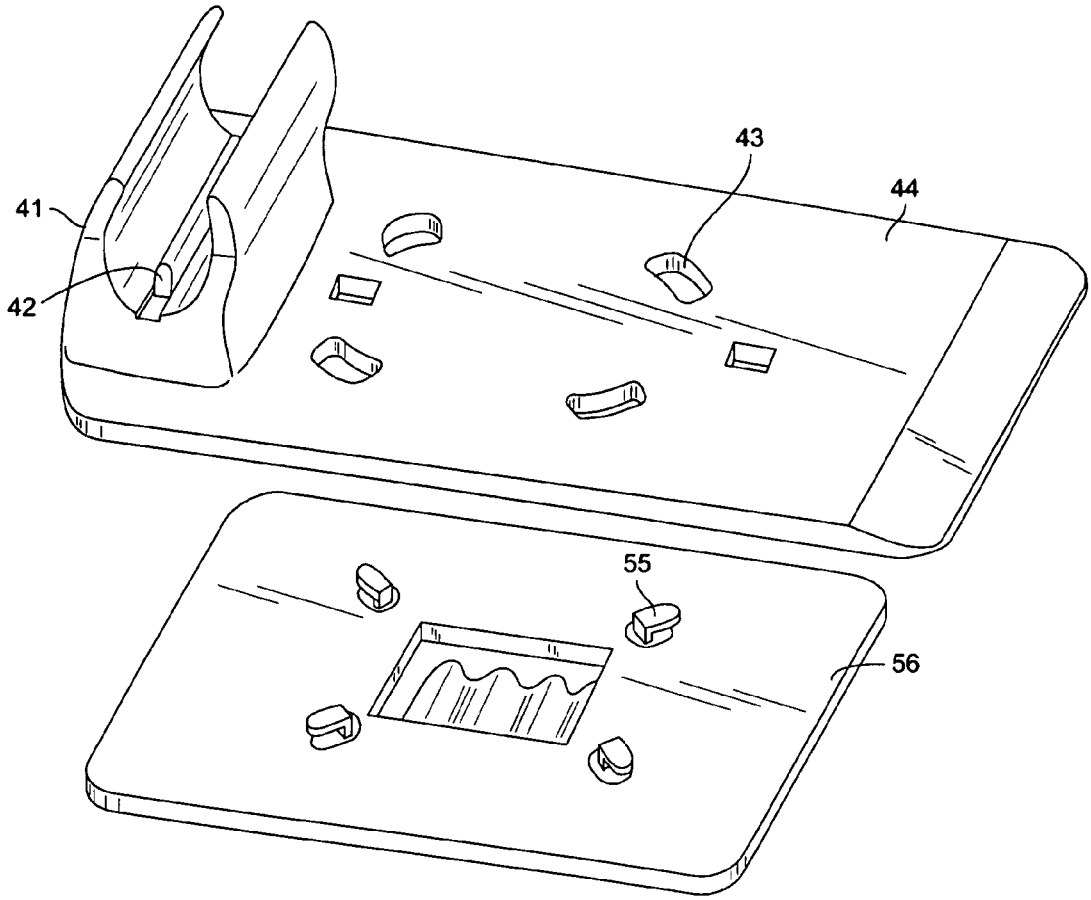

Turning first to FIGS. 7A and B, a base intended to reside upon a series of parallel wires 57 such as those employed in a refrigerated case is illustrated. Lower base 56 is provided with four upwardly extending protrusions 55 which are caused to pass within receiving slots 43. Upon rotation of the upper and lower bases 44 and 56 with respect to one another, the upper base can be caused to snap fit to the lower base and be retained thereby. Lower base 56 can then be removably retained by wires 57 through the use of clothesline clip 59 (FIG. 7B). Upon installation, stem 9, frame halves 15 and 16 or adapter 70 can then be employed by being received by C-shaped section 41 coupling with ridge 42 as described above. It is further noted that wires in refrigerated cases can be made to run either parallel to or perpendicular to the longitudinal axis of the case. Through the use of the embodiment shown in FIGS. 7A and 7B, upper base 44 can be rotated 90° with regard to the lower base 56 while protrusions 55 are snap fit within receiving slots 43. As such, regardless of the orientation of wires 57, the signage supported by the base configuration shown in FIGS. 7A and 7B can always be oriented in the appropriate direction.

Figure 8:
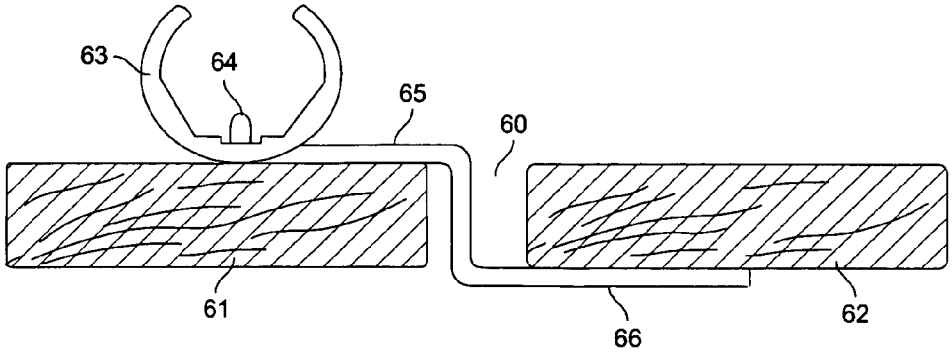
FIG. 8 is a side view of yet another embodiment of the present invention, in this instance, being a modification to a base member for use between wooden slats.

Yet a further configuration is shown in FIG. 8 whereby base 60 is intended to fit between parallel wooden slats 61 and 62 of a Euro-table, commonly found in grocery store displays. In this embodiment, base 60 is shown as having support legs 65 and 66 intended to fit above and beneath wooden slats 61 and 62, respectively. As in the previous embodiments, once base 60 is in place, C-shaped section 63 can capture either stem 9 or adapter 70 or frame halves 15 and 16 and maintain their appropriate orientation through the use of protrusion 64.

In this instance, assembly 108 (FIG. 10) comprising blade 107, shaft 109 and head 110 are appended to base 101. In use, base 101 is placed upon the Euro-Table with assembly 108 protruding between slats 104 and 105. Thereupon, base 101 is rotated 90° so that slats 104 and 105 capture blade 107 retaining base 101 and c-shaped section 102 and protrusion 103 in place.

Figure 10:
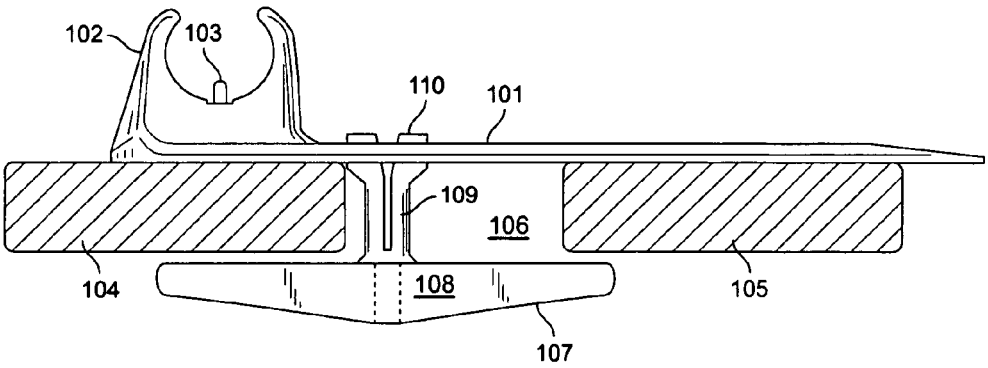
FIG. 10 is a cross-sectional view of yet another embodiment of the present invention, in this instance, being a modification to a base member for use between wooden slats.
Figure 11:
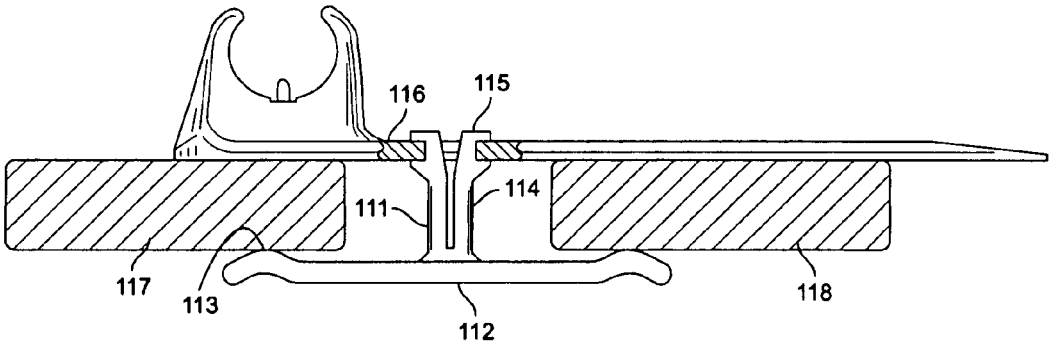
FIG. 11 is again a side cross-sectional view of a base member for use between wooden slats.

FIG. 11 shows a similar embodiment to that of FIG. 10 whereby base 116 is retained on a Euro-Table between slats 117 and 118 by rotating base 116 and appended blade 112, shaft 111 and head 115 90° causing its capture. Blade 112 is provided with lips 113 for causing a spring-like capture of base 116 to the top surface of adjacent slats 117 and 118.

Figure 12A:
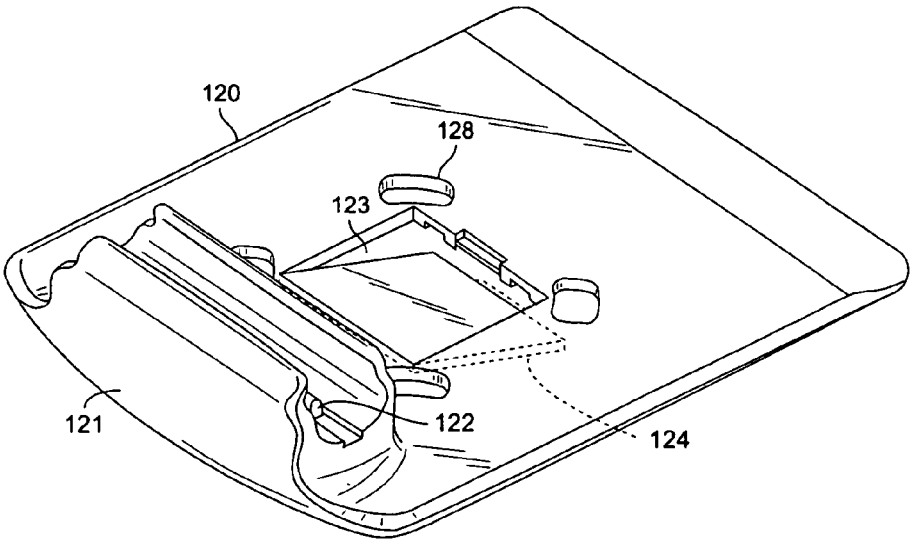
Figure 12B:
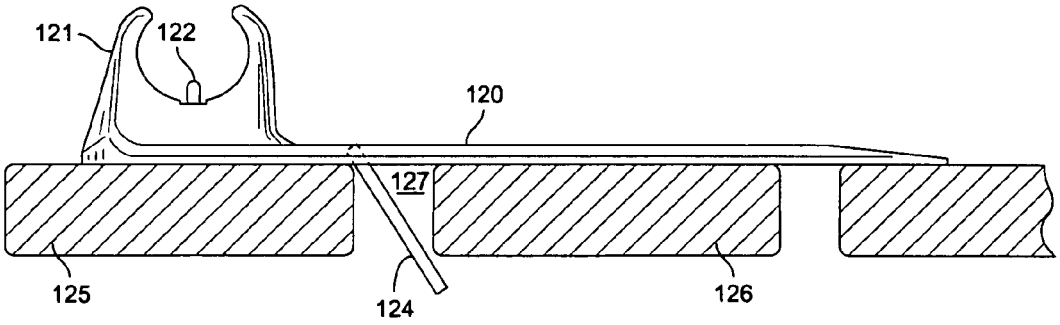
FIG. 12B is the base member shown in FIG. 12A in a side cross-sectional orientation.

Turning to FIG. 12A, base member 120 incorporating C-shaped receiving element 121 and ridge 122 can be employed as described above. In this instance, base 120 is provided with flap 124 which can be connected to the planar surface of base 120 through the use of a plastic web of material creating a living hinge. In use, flap 124 is depressed from its normal planar orientation with base 120 creating opening 123. Flap 124 is then placed between wooden slats 125 and 126 in opening 127 as shown in FIG. 12B. This substantially causes base 120 to resist movement along the Euro-table even when the surface of the table is inclined as shown in FIG. 12B. Further, as was noted with regard to FIGS. 7A and 7B, base 120 can be provided with openings 128 for receiving a lower base (not shown) in the event that a configuration or akin to that shown in FIGS. 7A and 7B are contemplated.

Figure 13A:
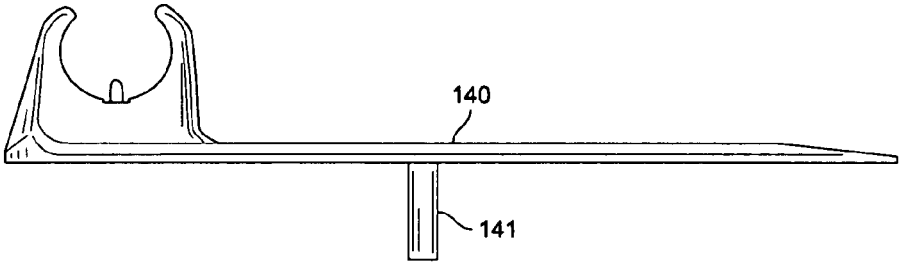
FIGS. 13A through 13D are various orientations of still a further embodiment of the present invention for its use between wooden slats.
Figure 13B:
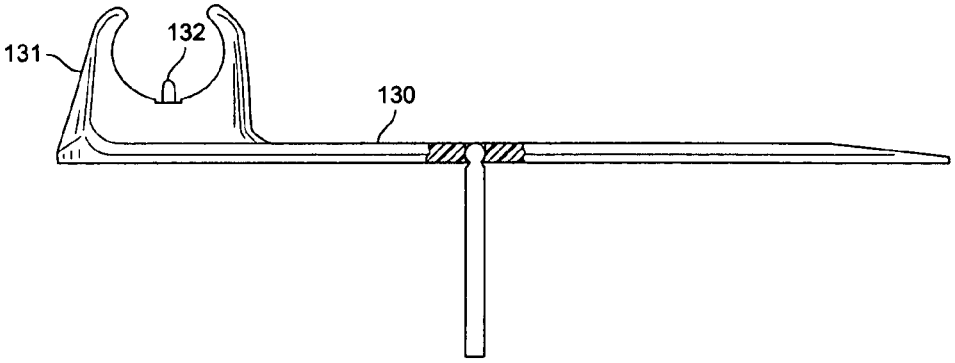
Figure 13C:
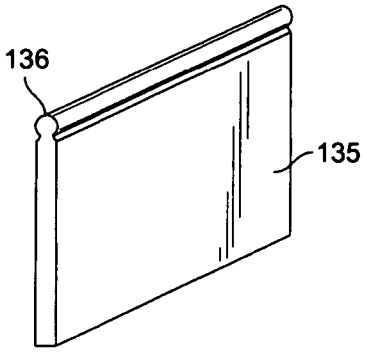
Figure 13D:
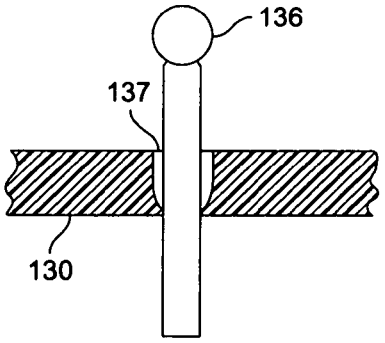

FIG. 13B shows yet a further embodiment whereby base 130 is intended to fit between parallel wooden slats (not shown) of the type discussed above. In this embodiment, base 130, again being provided with cylindrical portion 131 and ridge 132 are employed as in the previous embodiments of the present invention. In this instance, however, flap 135, as best shown in FIG. 13C, is provided with bulbous edge 136 such that when flap 135 is passed within base 130 as shown in FIG. 13D, bulbous end 136 is captured by socket 137 enabling flap 135 to extend between adjacent wooden slats (not shown) of the type discussed above. As an alternative, as shown in FIG. 13A, base 140 can be provided with flap 141 as a unitary fixed construction. Its function when extending between adjacent wooden slats would be as previously described.

Figure 14A:
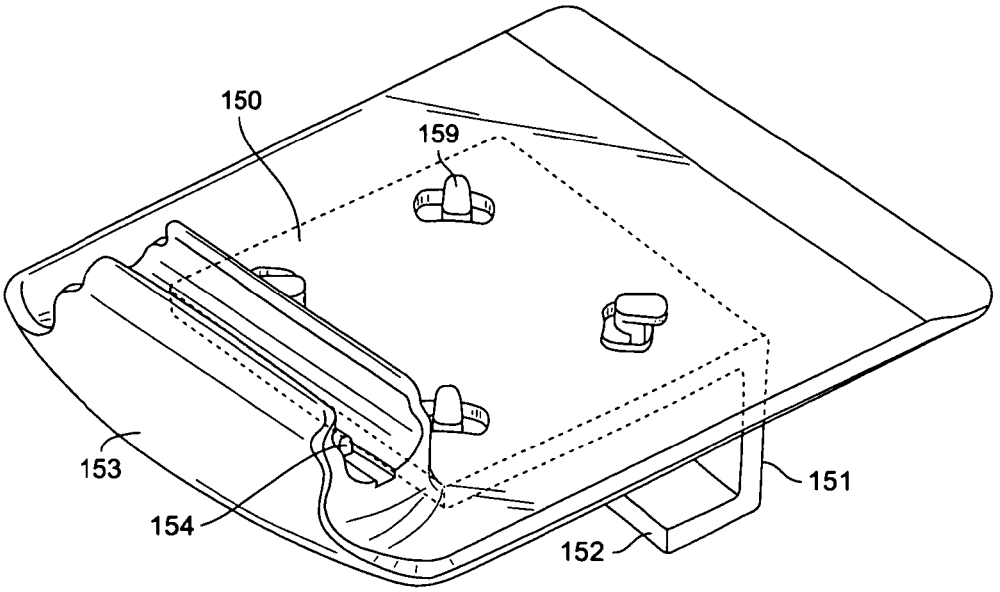
FIGS. 14A through 14C are a continuing embodiment of the present invention again being a modification to a base member for use between wooden slats.
Figure 14B:
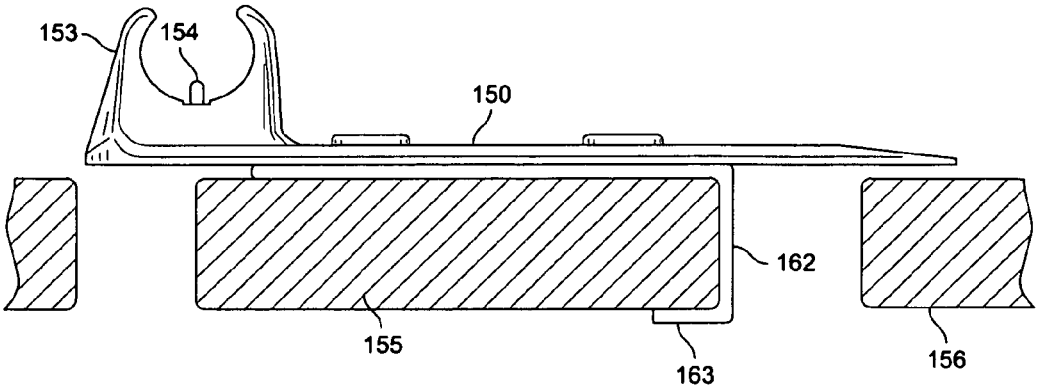
Figure 14C:
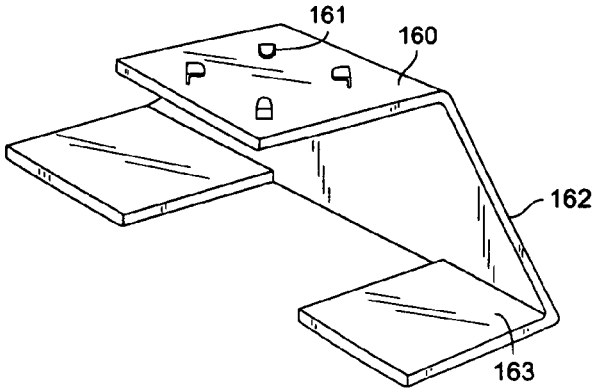

Reference is now made to FIGS. 14A through 14C again showing embodiments whereby a base can be retained between wooden slats (elements 155 and 156) of a typical Euro-table employed in a supermarket environment. In this instance, upper base 150 can again be provided with openings 159 for accepting protrusions 161 contained on lower base plate 160. As such, upper base 150 and lower base plate 160 can be locked together with a snap fit rotating motion. In use, lower base plate 160 is provided with vertical arm 162 and horizontal legs 163 which can surround and capture a wooden slat such as shown in FIG. 14B. Once upper base 150 is connected to lower base plate 160, cylindrical portion 153 and ridge 154 can be employed to accept a stem, adapter and/or frame in the manner described previously.

Figure 15:
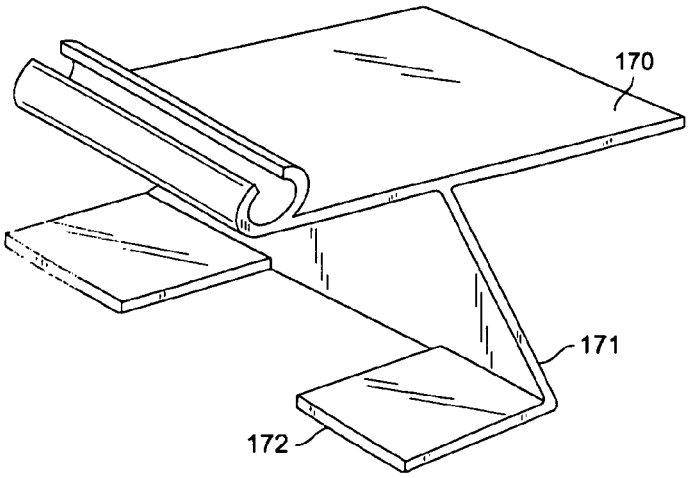
FIG. 15 is a further embodiment of the present invention again being a modification to a base member for use between wooden slats.

As a further alternative, reference is made to FIG. 15 whereby the base 170 can be molded as a unitary structure with vertical arm 171 and horizontal legs 172.

As noted, through the practice of the present invention, an extremely durable aesthetically pleasing sign can be constructed from a bin of parts quickly and without the need of skilled personnel. The sign, once constructed, can be used in a number of diverse areas throughout a retail establishment and thus provides the user with a degree of flexibility not enjoyed by similar signage of the prior art.

While various embodiments of the present invention have been shown and described, other modifications thereof are possible within the scope of the following claims.

We claim:

1. A sign holder device in the form of individual parts which, upon assembly, provides for support and display of signage in a plurality of orientations, said sign holder device comprising a base configured to be releasably attachable to a series of parallel extending wires, a stem having a first end and second end, said first end configured to be releasably retained by said base and said second end configured to retain a sign frame, and a sign frame configured to be retained by said second end of said stem wherein said base is comprised of an upper base and lower base, said lower base being attachable to said series of parallel extending wires whereby said upper base is configured to receive and retain the first end of said stem and wherein said lower base is provided with protrusions and said upper base provided with receiving slots such that said protrusions are sized and positioned to fit within said receiving slots releasably locking said upper base to said lower base.

2. The sign holder device of claim 1 wherein said protrusions and receiving slots are sized and located to enable said upper and lower bases to be repositioned with respect to one another.

3. The sign holder device of claim 2 wherein said upper base is rotatable by approximately 90 degrees with respect to said lower base.

4. A sign holder device in the form of individual parts which, upon assembly, provides for support and display of signage in a plurality of orientations, said sign holder device comprising a base configured to be releasably attachable to a series of parallel extending wires, a stem having a first end and second end, said first end configured to be releasably retained by said base and said second end configured to retain a sign frame, and a sign frame configured to be retained by said second end of said stem wherein said base is comprised of an upper base and lower base, said lower base being attachable to said series of parallel extending wires whereby said upper base is configured to receive and retain the first end of said stem and wherein said lower base is provided with receiving slots and said upper base provided with protrusions such that said protrusions are sized and positioned to fit within said receiving slots releasably locking said upper base to said lower base.

5. The sign holder device of claim 4 wherein said protrusions and receiving slots are sized and located to enable said upper and lower bases to be repositioned with respect to one another.

6. The sign holder device of claim 5 wherein said upper base is rotatable by approximately 90 degrees with respect to said lower base.

7. A sign holder device in the form of individual parts which, upon assembly, provides for support and display of signage, said sign holder device comprising a base having a clip configured to be releasably attachable to a series of parallel extending wires and a sign frame configured to be retained by said base wherein said base is comprised of an upper base and lower base, said lower base clip extending from said lower base and being attachable to said series of parallel extending wires whereby said upper base is configured to receive and retain said sign frame, and wherein said lower base is provided with protrusions and said upper base is provided with receiving slots such that said protrusions are sized and positioned to fit within said receiving slots releasably locking said upper base to said lower base.

8. The sign holder device of claim 7 wherein said protrusions and receiving slots are sized and located to enable said upper and lower bases to be repositioned with respect to one another.

9. The sign holder device of claim 8 wherein said upper base is rotatable by approximately 90 degrees with respect to said lower base.

10. A sign holder device in the form of individual parts which, upon assembly, provides for support and display of signage, said sign holder device comprising a base having a clip configured to be releasably attachable to a series of parallel extending wires and a sign frame configured to be retained by said base wherein said base is comprised of an upper base and lower base, said lower base clip extending from said lower base and being attachable to said series of parallel extending wires whereby said upper base is configured to receive and retain said sign frame, and wherein said lower base is provided with receiving slots and said upper base is provided with protrusions such that said protrusions are sized and positioned to fit within said receiving slots releasably locking said upper base to said lower base.

11. The sign holder device of claim 10 wherein said protrusions and receiving slots are sized and located to enable said upper and lower bases to be repositioned with respect to one another.

12. The sign holder device of claim 11 wherein said upper base is rotatable by approximately 90 degrees with respect to said lower base.

* * * * *